United States Patent [19]

Windischbauer

[11] Patent Number: 4,515,185

[45] Date of Patent: May 7, 1985

[54] APPARATUS FOR THE CONSTRAINED ACTUATION OF THE CLAMPING SYSTEM OF FILLING-YARN INSERTION DEVICES IN SHUTTLELESS WEAVING MACHINES

[76] Inventor: Florian Windischbauer, Pfeiffergässele 6, D 8990 Lindau, Fed. Rep. of Germany

[21] Appl. No.: 510,833

[22] Filed: Jul. 5, 1983

[30] Foreign Application Priority Data

Jul. 2, 1982 [DE] Fed. Rep. of Germany ..... 3224708

[51] Int. Cl.[3] ..... D03D 47/18

[52] U.S. Cl. ..... 139/446

[58] Field of Search ..... 139/443, 444, 445, 446, 139/447, 453

[56] References Cited

U.S. PATENT DOCUMENTS 3,364,954 1/1968 Kokkinis ..... 139/453

4,384,598 5/1983 Haussler ..... 139/446

*Primary Examiner*—Henry S. Jaudon

*Attorney, Agent, or Firm*—Werner W. Kleeman

[57] ABSTRACT

The invention relates to a shuttleless weaving machine with filling-yarn transfer at the center of a shed from a first gripper system advanced from one side to a second gripper system approaching from the other side. The yarn transfer is implemented by opening and subsequently closing the clamping means of the gripper systems by means of control levers which are made to enter from the outside through the warp threads into the shed. The control levers themselves are mounted at fixed locations and are so shaped and can be so pivoted form an operational position within the shed into a rest position below the shed that, when the read beats up, the reed stay can pass unhindered over the control lever.

9 Claims, 4 Drawing Figures

APPARATUS FOR THE CONSTRAINED ACTUATION OF THE CLAMPING SYSTEM OF FILLING-YARN INSERTION DEVICES IN SHUTTLELESS WEAVING MACHINES

The present invention broadly relates to weaving machines and, more specifically, pertains to a new and improved construction of an apparatus used in shuttleless weaving machines where the filling insertion takes place on one side by means of advanced and then retracted gripper systems provided with clamping means for the filling-yarn.

Such a weaving machine is known for instance from German Pat. No. 1,710,922. In this patent, the filling-yarn is seized by the clamping means of a gripper system when outside of the shed and is moved by the gripper to the approximate shed center. There, the filling is transferred to the clamping means of a gripper system advanced from the opposite side which, upon retraction, pulls the filling entirely through the shed. The yarn transfer at the center of the shed takes place while the participating clamping means are controlled in a constrained manner in such a way as to provide for a brief time during which control levers pass through the shed's warp threads to open and then again close the clamping means. The actuation of the control levers is coupled to the main drive for the weaving machine and takes place not only when the filling-yarn is transferred in the shed's center, but also can be used when seizing and releasing the filling-yarn outside of the shed.

The control system is designed in such a manner that the control lever is pivotally supported on the end of arms which themselves are rigidly seated on the sley shaft and accordingly carry out a pivoting motion together with the sley during the beating-up of a filling-yarn. A pivot lever acting as a support for sensor rolls is furthermore rotatably seated on the sley shaft, where the sensor rolls rest under spring loading against a cam. The cam is mounted on a special, continuously rotating shaft parallel to the sley shaft. The connection between the control lever and the pivot lever is provided by a connecting rod. This side shaft rotating at 1:1 is parallel to the main shaft assuring the power transmission of the reed and gripper drive from one side of the weaving machine to the other and advantageously rotates for instance in the ratio of 3:1 or 4:1. However, the geometry of weaving machines permits only a limited space for mounting and sizing the main shaft, the side shaft with cams, and the sley shaft. In particular, it is impossible to select the cams in an adequately larger size.

When beating-up, the above-cited arm not only carries along the control lever, but it furthermore, by means of a stop and driver, rotates the pivot lever whereby the sensing roll is lifted from the cam. The spacing between the stop and the driver must be precisely set in order to achieve the proper motion of the control lever during reed beat-up.

It is characteristic of this equipment that at higher operating speeds of the weaving machine, the rolls no longer snugly adhere to the cam resting surface but lift off it and tend to bounce. As a result, they will also lift off in undesired manner from the control cam resting surface against which they are supposed to rest according to the control curve which is desired. Because the control levers follow, by means of the connecting rod, the motion of the rolls, i.e., the motions of the pivot lever, the clamping means at the gripper systems may be spuriously actuated. Threfore, flawless filling yarn transfer from one gripper system to the other is no longer assured in such a case. Moreover, the bouncing and reseating of the rolls greatly stresses, and possibly damages, the cam resting surfaces.

German Pat. No. 2,934,474 describes a modified apparatus. In this apparatus, the pivot lever sensing the cam motion is rotatably supported but fixed to the machine outside the sley shaft. This design averts the above-cited difficulties and even at high operating speeds of the weaving machine, improved yarn transfer is achieved. In this design, the center of rotation of the pivot lever for driving the connecting rod and the control lever no longer is situated in the sley shaft and the roll no longer lifts off of the cam but, on the contrary, the rolls alaways remain on the cam's control curve. Furthermore, it is no longer necessary as previously to precisely set the costly and highly stressed rest surface at the stop and driver. Moreover, an improved arrangment of the return spring is possible at the pivot lever, and no interfering inertial forces arise at the spring during reed beat-up.

Nevertheless, a further factor adversely affects both of the known apparatuses. This factor is that the control lever is mounted on the end of a special arm and upon reed beat-up is pivoted together with the arm out of the shed and back in addition to its own control motion. The number of required individual parts and bearing sites or joints results in a not insignificant play. Due to the vibrations of the arms and of the control lever due to the hard stopping motion of the reed, this play becomes noticeable at the control site, that is, at the end of the control lever, and may impair the control function. Additionally, another problem arises. It has been noted in practice that at higher operating speeds of the weaving machine, the uncontrolled vibrations arising at the control parts due to the inertial forces exceed by far the actually required control force. Consequently, in these known designs, the springs of the cam sensor means always must be tightened harder. The high spring force results in excessive wear and furthermore constitutes an impediment when the weaving machine must be turned by hand.

SUMMARY OF THE INVENTION

Therefore, with the foregoing in mind, it is a primary object of the present invention to provide a new and improved construction of an apparatus for constrained actuation of clamping means in a shuttleless weaving machine which does not exhibit the aforementioned drawbacks and shortcomings of the prior art constructions.

Another and more specific object of the present invention aims at providing a new and improved construction of an apparatus for constrained actuation of clamping means in a shuttless weaving machine which so improves the operation of the foregoing equipment that the tendency to vibrate is further reduced and that overall there will be little play in the individual parts. This makes it possible to achieve higher operating speeds of the weaving machine with more reliability in filling-yarn pick-up or transfer by the gripper systems, and hence to improve the efficiency thereof. Further, the special side shaft and the related or above-cited drawbacks are eliminated.

Yet a further significant object of the present invention aims at providing a new and improved construction of an apparatus for constrained actuation of clamping machines in a shuttleless weaving machine of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the apparatus of the present invention is manifested by the features that it is used in shuttleless weaving machines with the filling-yarn being inserted from one side by gripper systems advanced into and retracted from the shed and provided with clamping means for the filling-yarn, the gripper systems being used to actuate in a constrained manner the clamping means by control levers passing from the outside through the warp threads into the shed and controlled by cams. Each of the control levers which is otherwise spatially fixed to the weaving machine underneath the width of the fabric is rotatably supported and rendered pivotal from its operational position entering the shed into a rest or idle position below the path of motion of the reed i.e. the reed stay. In a further embodiment of the invention, the control lever includes at least one further arm connected to a cam system controlled in a constrained manner.

Advantageously, the cam means are mounted on a cam shaft of known construction and extending below the fabric, controlling the devices provided on both sides of the weaving machine and processing the ends of the filling yarns before and/or after the insertion of the filling. In this manner, the special 1:1 side shaft required in known equipment is eliminated; henceforth both the main shaft and the sley shaft can be designed without restriction to meet the particular requirements. Vibrating levers and cams are now eliminated in the vertical region between the main shaft and the sley shaft, and space is hence available for a sufficiently large tubular reed shaft, whereby gearing to drive the reed is now required only on one side of the weaving machine. The one-sided reed drive with a large reed shaft provides improved dynamic behaviour of the reed at high angular speeds compared to the previously conventional double drive because a double drive prevents perfect synchronization on the other side of the weaving machine, leading to reed vibrations in the beating-up. However, such vibrations cause additional wear in the gripper systems which are guided by the reed and may impair the transfer of the filling-yarn and cause weaving defects. These drawbacks are remedied by the present invention. Furthermore, a one-sided reed drive represents a saving in gear parts and hence an appreciable reduction in costs.

Because the special arm on the sley shaft is eliminated and because the control lever is held by a spatially fixed bearing, both the tendency to vibrate due to the reed beat-up is entirely eliminated as are the special pivot levers and the long connecting rod, and now the entire apparatus can be mounted compactly between the fabric and upper crossbeam connecting the two sides of the weaving machine frame. Long control bars and a substantial number of play-incurring bearings are no longer required. Because of the constrained cam control, for instance by double eccentrics or slot eccentrics, the difficulties caused by return springs also are prevented. As a whole, the invention not only provides more reliability in the control function and a higher operating speed of the weaving machine, but also a reduction of the manufacturing costs and decreased maintenance expenses, because less wear takes place in view of the smaller number of individual parts.

As the control lever no longer is coupled to the reed and no longer is moved together with it out of the shed but, rather, is moved into a rest position prior to beating-up and the reed being displaceable over the control lever in its rest position, the control lever is advantageously bent into such a shape that in its rest position its upper boundary is substantially fitted to the lower contour of the reed.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
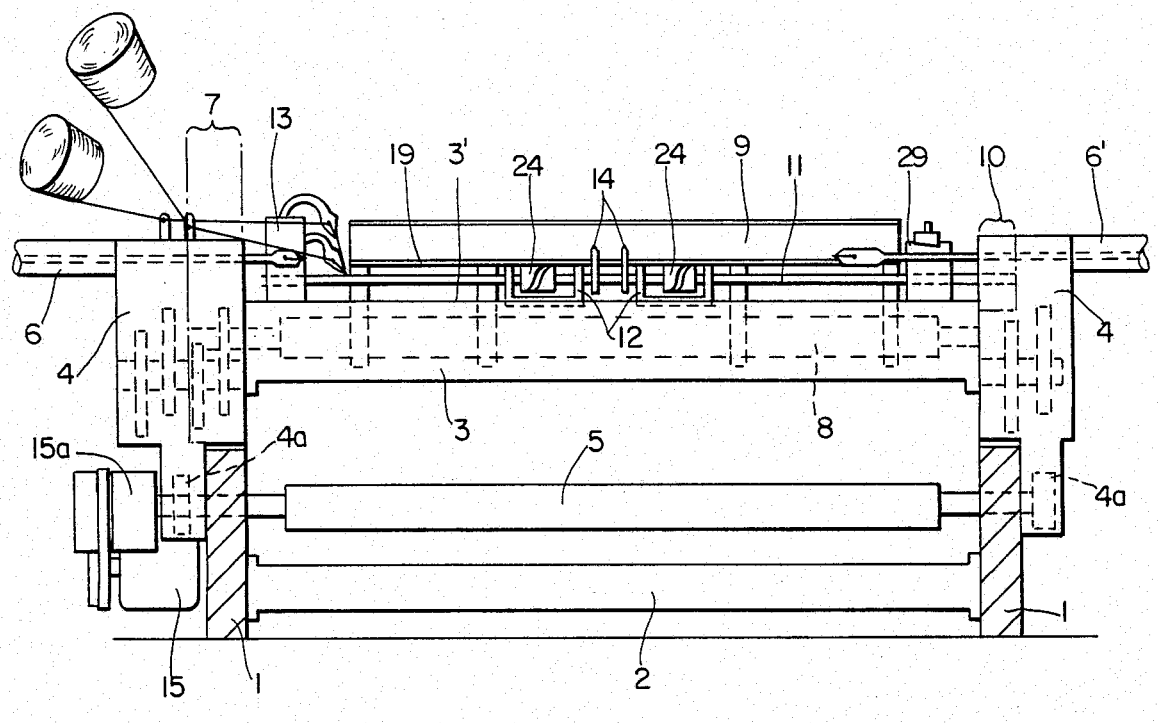
FIG. 1 is a schematic view of the control system mounted on a weaving machine.

Describing now the drawings, it is to be understood that to simplify the showing thereof only enough of the structure of the apparatus for constrained actuation of clamping means in a shuttleless weaving machine has been illustrated therein as is needed to enable one skilled in the to readily understand the underlying principles and concepts of this invention. Turning now specifically to FIG. 1 of the drawings, this Figure schematically shows the most important parts of a weaving machine as viewed from the front. This is a weaving machine with filling insertion, for instance by rigid gripper bars advanced from both sides into the shed and inserting the filling from the left side, transferring it at the center of the shed, and drawing it out toward the right side of the machine. The side walls 1 are indicated as the support components for the weaving machine; they are connected together by a lower crossbeam 2 and an upper crossbeam 3. A main drive motor 15 with a connected electromagnetic clutch/brake device 15*a* is mounted on the left side wall 1. From there, the drive passes through the transmission steps 4*a* to the transmission 4 from which is tapped, for instance, the gripper drive, etc. A main shaft 5 provides the synchronization of the main transmission 4 on the left and right sides of the machine. The main shaft 5 rotates, for instance, in the ratio of 3:1 or 4:1, depending upon the design of the two transmission steps 4*a* on the left and right sides of the machine in order that there be a speed ratio of 1:1. A transmission part 7 driving the sley shaft 8 is powered from the main transmission 4 on the left side of the weaving machine. Arms, not designated further, are seated on the sley shaft 8 and support the reed stay 19 and the reed 9 mounted thereon. The main shaft 5 and the sley shaft 8 in this instance are designed as tubular shafts. The transmission part 7 in this illustration is required on one side only of the weaving machine because a tubular shaft 8 is used.

The overall operation of the invention will now be described. The gripper bars for inserting the filling-yarn are indicated above the gears 4 and indicated by 6 and 6'. The filling-yarn is withdrawn from supply spools, not designated further, and located on the left side of the weaving machine, and is advanced by a filling-yarn insertion means 13 of the left gripper bar 6 and seized by its clamping means to insert the filling. During the insertion, the left gripper 6 in its function as the donor gripper moves the filling-yarn approximately into the center of the shed where it transfers it to the acceptor gripper 6', which was also advanced to that location from the right side. In the process, the control levers 14 are consecutively activated to transfer the filling-yarn from the clamping means of the left gripper 6 to the clamping means of the right gripper 6'. When the gripper bars are retracted, the filling-yarn is pulled out of the shed toward the right and is taken off by a yarn pick-up device schematically indicated at 29. The motions of the various components taking part in the filling-yarn insertion, for instance of the donor device 13, of the yarn pick-up device 29 or of other parts not shown, for instance filling-yarn shears, filling-yarn lay-in device, etc. are powered from a control shaft 11 passing above the upper crossbeam 3 from one side to the other of the weaving machine. The transmission 10 for the control shaft 11 is provided on one side only of the machine and assures a 1:1 drive. In the invention, this control shaft 11 also drives the control levers 14, and therefore also drives their control parts or drive cams 24.

Figure 2:
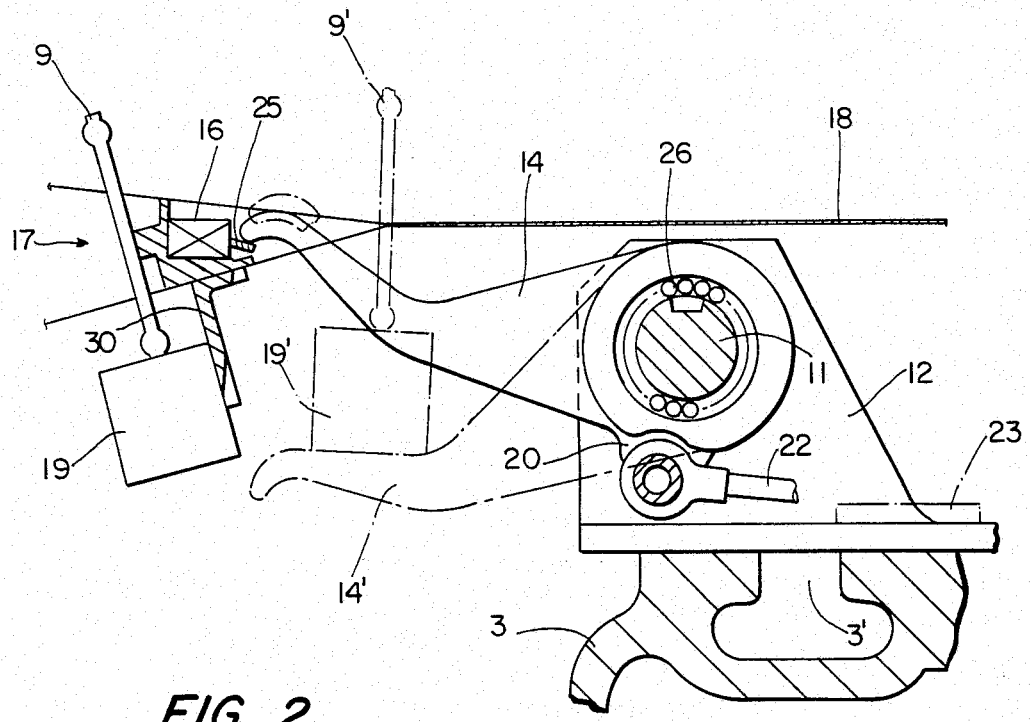
FIG. 2 is a view in cross-section of the control system with the control levers and cams mounted on a common shaft.

As shown in FIG. 2, the control levers 14 are mounted on blocks 12 displaceable along the crossbeam 3. These blocks 12 also support, as indicated in FIG. 1, in addition to the control levers 14, their drive means, for instance slot cams 24.

Figure 3:
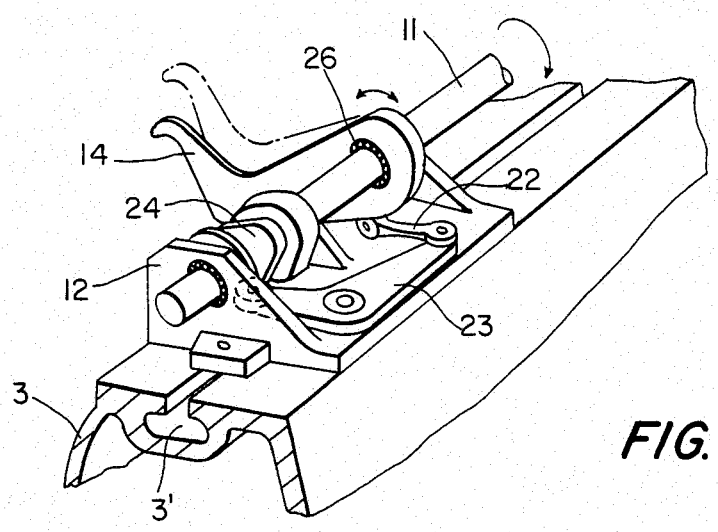
FIG. 3 is a perspective view of the arrangement of FIG. 2.

Details of the control system are shown in FIGS. 2 and 3. The upper crossbeam 3 is provided with a groove 3' wherein a block 12 can be displaced and tightened, for instance by screws. The control shaft 11 is rotatably supported in the block 12. The block 12 and the control shaft 11 are located below the fabric path 18. A small control lever 14 is rotatably supported in a pivot bearing 26 on the control shaft 11. The control lever 14 has a gooseneck shape. Its free end, when in the operational position shown in solid lines, passes from below through the warp threads and in the form of a finger into the shed 17 where it comes to rest against an actuating lever 25 for the gripper clamp. The reed 9 is shown in the shed and is supported by the reed stay 19. The gripper system 16 moves the filling-yarn as shown into the shed; the above-cited actuation lever 25 for the clamping means at the gripper system projects sideways to the right from the gripper system 16 in this illustration. To open the clamping means, the end of the control lever 14 presses the actuation lever 25 by means of a slight pivoting motion from the position shown at the top in dash-dot lines to the operational position shown in solid lines. The clamping means is thereby briefly opened for yarn transfer. To close the clamping means, the control lever 14 rises again into the position shown in dash-dot lines. When the clamping means is actuated, the gripper system 16 on the one hand rests on the reed 9 and on the other hand also against a guide strip 30 mounted to the reed stay 19.

After the yarn has been transferred from the donor to the acceptor gripper, both gripper systems 16 are retracted. Subsequently, the control lever 14 can be immediately moved by cam control out of the shed 17 and can be pivoted into its rest or idle position 14', shown in dash-dot lines, and to such an extent downward that during the reed beat-up the reed stay 19 can be moved into its position 19' and the reed into the position 9', without being hampered by the control lever 14. The stop motion of the reed stay from the position 19 into position 19' takes place above the contour of the control lever in its position 14'. Due to the gooseneck shape, the reed stay 19' fits well and without undue bulk to the upper edge of the control lever in its position 14'. While during the simple pivoting motion of the control lever 14 into its position 14' the gripper system 16 with its actuation lever 25 is retracted out of the path of the control lever so that the latter is not hampered, the guide strip 30 nevertheless still might be in the way of the pivoting motion. Therefore, clearances may be provided in the guide strip 30 allowing passage to the free end of the control lever 14. FIG. 2 shows such clearances in the guide strip 30 by the interrupted shading. The pivoting motion of the control lever 14 is indicated in dash-dot lines and the lever passes through the clearances.

A constrained-control eccentric system is provided to control the motion of the control lever 14. FIG. 3 shows an axial slot cam 24 mounted on the control shaft 11. The actuating motions of the control lever 14 determined by the path of the slot and its pivoting motion from the operational into the rest position are transmitted from an angle lever 23 with connecting rod 22 to the control lever 14. The angle lever 23 is mounted parallel to the surface of the crossbeam 3, that is to the bottom of the block 12, and can be pivoted about a bolt, not designated further. One end of the angle lever 23 by means of a sensor roll or the like engages the slot of the cam 24, whereas the other end is connected in an articulated manner with the connecting rod 22. The control lever 14 is provided with another lever arm 20 to connect with the connecting rod 22. The axes of rotation of the link points at the ends of the connecting rod 22, that is, on the one hand to the arm 20 and on the other hand to the angle lever 23, are mutually orthogonal.

Figure 4:
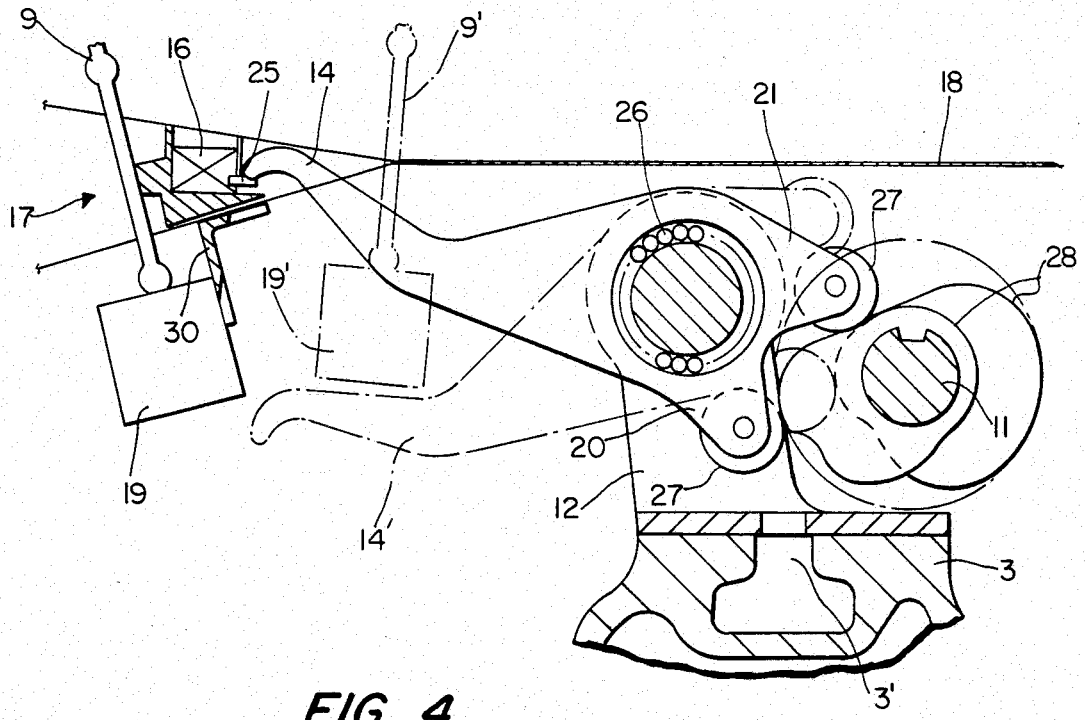
FIG. 4 is a modification of the arrangement of FIG. 2 with the control levers and cams on separate axes of rotation.

FIG. 4 shows another embodiment for the control lever 14 arrangement. Again, this arrangement is underneath the fabric path 18 and is displaceable on a block 12 in a groove 3' of the crossbeam 3. Contrary to the case for FIG. 2, the control lever 14 in this instance is supported not on the control shaft 11, but rather with a separate axis of rotation in a bearing 26 of the block 12 parallel to the axis of the control shaft 11. In this instance, the control lever 14 includes two further arms 20 and 21, each bearing a sensor roll 27 to sense the cam motion. The constraned-control cam in this instance is assumed to be a double eccentric 28 solidly connected to the control shaft 11. Each of the rolls 27 rests against its associated cam disk 28. This constrained control allows dispensing with return springs for the control lever 14 and hence with their possible drawbacks. The design of the control lever 14 and its operation in cooperation with the reed 9 and the gripper system 16 is similar to the example of FIG. 2. In this instance also the control lever 14 dips from its operational position, shown in solid lines, into a dash-dot rest or idle position 14' below the path of motion of the reed stay from its position 19 into its position 19'.

Two control levers 14 are provided in FIG. 1 approximately at the center of the weaving machine, each being mounted on a separate and displaceable block 12. This makes possible precise adjustment both for the donor gripper 6 introduced from the left and for the acceptor gripper 6' introduced from the right, and a separate, finely time-stepped control of the two grippers. The control levers 14 themselves are mounted in the space between two mutually adjoining arms connecting the reed stay 19 to the sley shaft 8. As already mentioned above, the shaft 11 serves the devices needed for filling insertion, for instance for yarn tendering and yarn pick-up outside of the shed, and also to control the two control levers within the shed. Where called for, further control levers and cams may be provided for the control shaft and may be mounted on the side next to the shed or to the reed, to there control the pick-up of the filling-yarn tendered by the donor device 13 by means of the left donor gripper 6 or the release of the completely drawn-through filling-yarn from the right acceptor gripper 6'.

While there are shown and described present preferred embodiments of the invention, it is to be distinctly understood that the invention is not limited thereto, but may be otherwise variously embodied and practiced within the scope of the following claims.

Accordingly, what I claim is:

1. In an apparatus employed in a shuttleless weaving machine wherein filling-yarn is inserted by gripper systems which are bilaterally advanced into the shed and then retracted and which are provided with clamping means for the filling-yarn for constrained actuation of the clamping means by control levers controlled by cam means and entering through the warp threads of the shed from the exterior, the improvement which comprises:

means for rotatably mounting said control levers below a path of travel of a fabric being woven at the weaving machine;

means for pivoting said control levers out of an operative position entering said shed into an idle position beneath a path of motion of a reed stay;

said cam means comprising a constrained-control cam system;

said constrained-control cam system including cam devices;

a control shaft extending beneath said path of travel of said fabric;

means for mounting said cam devices on said control shaft;

control means arranged bilaterally of the weaving machine for processing ends of said filling-yarn before and after said filling-yarn is inserted into the shed;

said rotatably mounting means comprising pivot bearings provided for said control levers;

sensing rolls cooperating with each of the control levers;

said cam devices each comprising a double eccentric mounted on said control shaft;

means for mounting said pivot bearings such that an axis thereof is parallel to said control shaft; and each said control lever including two arms for contacting said double eccentric through said sensing rolls.

2. In an apparatus employed in a shuttleless weaving machine wherein filling-yarn is inserted by gripper systems which are bilaterally advanced into the shed and then retracted and which are provided with clamping means for the filling-yarn for constrained actuation of the clamping means by control levers controlled by cam means and entering through the warp threads of the shed from the exterior, the improvement which comprises:

means for rotatably mounting said control levers below a path of travel of a fabric being woven at the weaving machine;

means for pivoting said control levers out of an operative position entering said shed into an idle position beneath a path of motion of a reed stay;

said cam means comprising a constrained-control cam system;

said control levers each including at least one arm operatively connected to said constrained-control cam system;

said constrained-control cam system including cam devices;

a control shaft extending beneath said path of travel of said fabric;

means for mounting said cam devices on said control shaft;

control means arranged bilaterally of the weaving machine for processing ends of said filling-yarn before and after said filling-yarn is inserted into the shed;

said rotatably mounting means comprising pivot bearings provided for said control levers;

means for mounting said pivot bearings on said control shaft;

said cam devices each comprising axially slotted cam means arranged on said control shaft;

a transmitting member operatively connected to each said control lever and comprising an angle lever with a linked connecting rod; and said linked connecting rod having ends with axes of rotation which are mutually orthogonal.

3. In an apparatus employed in a shuttleless weaving machine wherein filling-yarn is inserted by gripper systems which are bilaterally advanced into the shed and then retracted and which are provided with clamping means for the filling-yarn for constrained actuation of the clamping means by control levers controlled by cam means and entering through the warp threads of the shed from the exterior, the improvement which comprises:

means for rotatably mounting said control levers below a path of travel of a fabric being woven at the weaving machine;

means for pivoting said control levers out of an operative position entering said shed into an idle position beneath a path of motion of a reed stay;

said cam means comprising a constrained-control cam system;

said control levers each including at least one arm operatively connected to said constrained-control cam system;

said constrained-control cam system including cam devices;

a control shaft extending beneath said path of travel of said fabric;

means for mounting said cam devices on said control shaft;

control means arranged bilaterally of the weaving machine for processing ends of said filling-yarn before and after said filling-yarn is inserted into the shed;

a cross beam provided with a groove;

block means displaceably mounted within said groove; and means for mounting said control levers and said cam means on said block means.

4. In an apparatus employed in a shuttleless weaving machine wherein filling-yarn is inserted by gripper systems which are bilaterally advanced into the shed and then retracted and which are provided with clamping means for the filling-yarn for constrained actuation of the clamping means by control levers controlled by cam means and entering through the warp threads of the shed from the exterior, the improvement which comprises:

means for rotatably mounting said control levers below a path of travel of a fabric being woven at the weaving machine;

means for pivoting said control levers out of an operative position entering said shed into an idle position beneath a path of motion of a reed containing a reed stay;

said reed having a guide surface; and said guide surface having clearances in the region of said control levers for said gripper systems.

5. In an apparatus employed in a shuttleless weaving machine wherein filling-yarn is inserted by gripper systems which are bilaterally advanced into the shed and then retracted and which are provided with clamping means for the filling-yarn for constrained actuation of the clamping means by control levers controlled by cam means and entering through the warp threads of the shed from the exterior, the improvement which comprises:

means for rotatably mounting said control levers at a fixed location below a path of travel of a fabric being woven at the weaving machine; and means for pivoting said control levers out of an operative position penetrating said shed into an idle position beneath a path of motion of a reed stay of a reed of the weaving machine.

6. The improvement as defined in claim 5, wherein:

said cam means comprise a constrained-control cam system; and said control levers each including at least one arm operatively associated with said constrained-control cam system.

7. The improvement as defined in claim 6, further including:

cam devices defining said constrained-control cam system;

a control shaft extending beneath said path of travel of said fabric;

means for mounting said cam devices on said control shaft; and control means arranged bilaterally of the weaving machine for processing ends of said filling-yarn before and after said filling-yarn is inserted.

8. The improvement as defined in claim 7, further including:

a control shaft cooperating with said means for rotatably mounting said control levers; and a plurality of said control levers together with the respective cam means controlling each said control lever being associated with said control shaft.

9. The improvement as defined in claim 5, wherein:

said reed stay has a lower profile which passes above said control levers during beat-up of the inserted filling-yarn;

each said control lever having a bearing region and an upper profile; and each said control lever being bent upwardly in gooseneck form from said bearing region such that said upper profile of said control lever essentially conforms to said lower profile of said reed stay when said control lever is in said idle position.

* * * * *

UNITED STATES PATENT AND TRADEMARK OFFICE

CERTIFICATE OF CORRECTION

PATENT NO. : 4,515,185

DATED : May 7, 1985

INVENTOR(S) : FLORIAN WINDISCHBAUER

It is certified that error appears in the above—identified patent and that said Letters Patent is hereby corrected as shown below:

Abstract, line 11, change "form" to read --from--
Abstract, line 12, change "read" to read --reed--

Column 1, line 15, change "1,710,922" to read --1,710,292--
Column 1, line 51, change "larger" to read --large--

Column 2, line 1, change "Threfore" to read --Therefore--
Column 2, line 16, change "alaways" to read --always--
Column 2, line 56, change "shuttless" to read --shuttleless--

Column 4, line 40, after "the" (first instance), please insert --art--

Column 6, line 56, change "constraned-control" to read --constrained-control--

Signed and Sealed this

*Eighth* Day of *October 1985*

[SEAL]

*Attest:*

*Attesting Officer*

DONALD J. QUIGG

*Commissioner of Patents and Trademarks—Designate*